United States Patent [19]

Bell

[11] 3,943,269

[45] Mar. 9, 1976

[54] PAPER FELT AND PROCESS FOR MAKING THE SAME

[76] Inventor: David B. Bell, 6441 Cerritos St., Long Beach, Calif. 90805

[22] Filed: May 24, 1974

[21] Appl. No.: 473,307

Related U.S. Application Data

[63] Continuation of Ser. No. 334,904, Feb. 22, 1973, abandoned.

[52] U.S. Cl. ..... 427/302; 162/171; 162/179; 427/322; 427/374; 427/385

[51] Int. Cl.[2]... B32B 5/06; B32B 5/22; B44D 1/092

[58] Field of Search ..... 117/60, 62, 62.1, 62.2, 117/140 R, 158, 168, 92, 56; 162/171, 179; 427/302, 322, 374, 385

[56] References Cited

UNITED STATES PATENTS

| | | | |
|---|---|---|---|
| 1,417,840 | 5/1922 | Kirschbraun | 117/60 |
| 2,801,937 | 8/1957 | Hess | 117/92 X |
| 3,711,314 | 1/1973 | Campbell | 117/56 |

*Primary Examiner*—Michael R. Lusignan
*Attorney, Agent, or Firm*—Georges A. Maxwell

[57] ABSTRACT

The process for producing roofing felt which is softer, more flexible and more fire-resistant than such felt commonly produced by the prior art and which consists of permeating the felt stock with a treating fluid comprising a mixture of oil and soda ladened water, next drying the treated felt stock to remove excess moisture therefrom, next impregnating the felt with heated molten asphalt, next permitting excess molten asphalt to drain therefrom and finally permitting the asphalt in the felt to cool.

8 Claims, 2 Drawing Figures

PAPER FELT AND PROCESS FOR MAKING THE SAME

Figures 1, 2:
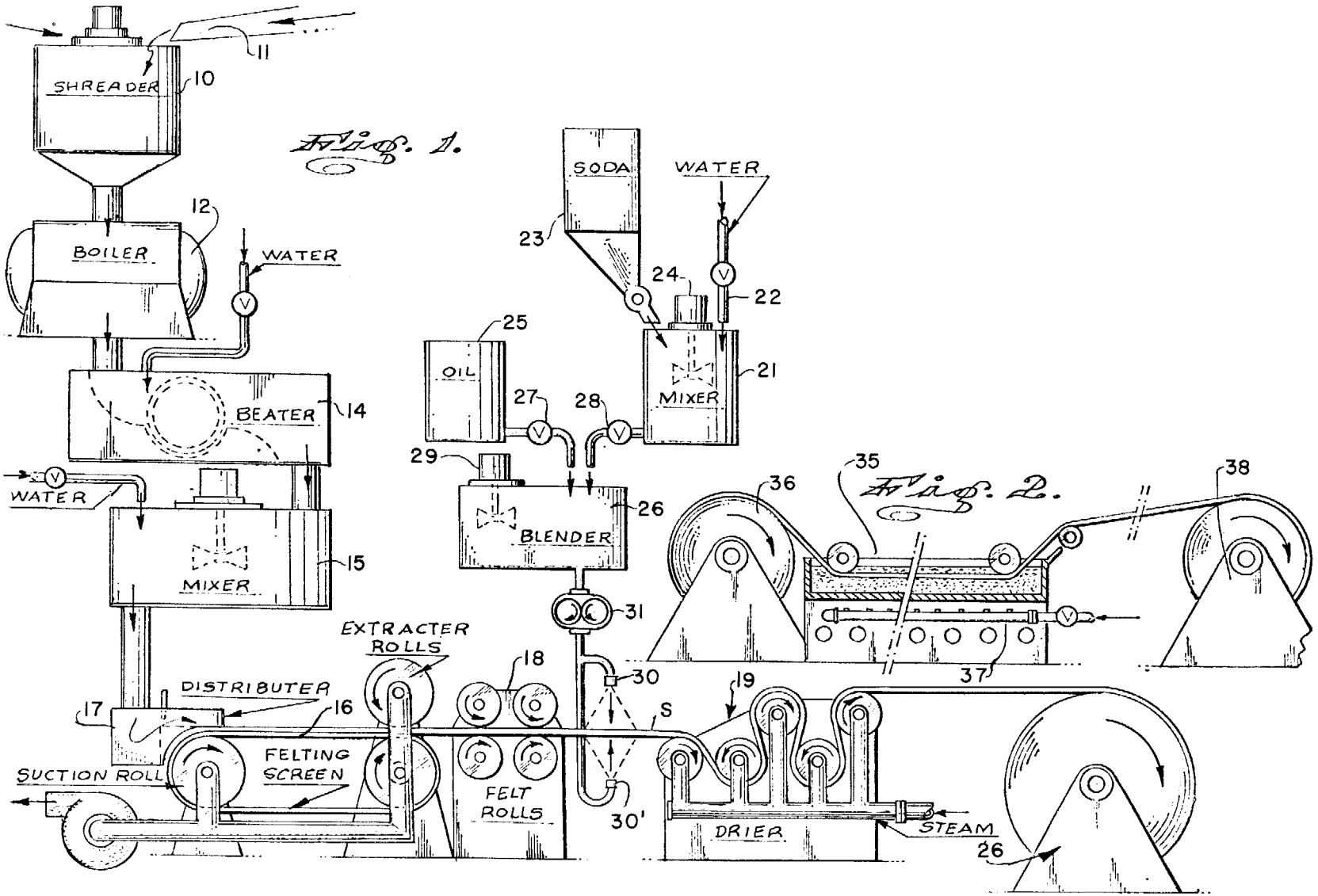

This is a continuation of my co-pending application Ser. No. 334,904, filed Feb. 22, 1973, for "PAPER FELT AND PROCESS FOR MAKING THE SAME."

This invention has to do with improved roofing felt or tar paper, such as is used to cover roofs and such as is employed in the manufacture of that class of roofing materials commonly referred to as "composition roofing" or "composition shingles." More particularly, the instant invention is concerned with a novel process of making my improved roofing felt.

Tar paper or roofing felt consists of course, porous, uncalendered, unsized, low grade, paper cardboard or felt stock, impregnated or saturated with that heavy, tar-like petroleum residue known as asphalt. In establishing roofing felt, the felt stock is first established in a paper mill by appropriate means and techniques commonly employed in the manufacture of cardboard stock, with the exception that no filler materials, such as clay, and little or no sizing or binding materials, such as glue, which would interfere with the saturation of the stock with asphalt, are provided or employed. The prepared or finished felt stock is then submerged in a hot, molten bath of asphalt for a sufficient period to assure complete saturation of the felt with the asphalt and is finally extracted from the bath and let to cool.

While the above appears to be an extremely simple and straight-forward procedure, it is not without serious shortcomings and the end product is wanting in a number of ways.

The felt stock, for economic reasons, is made primarily of reclaimed waste materials such as paper and rags with a minimum amount of new, yet inexpensive, raw material, such as peat, to provide a sufficient quantity of long fibers to tie and bind together the normally soft, short and weakened fibers of the reclaimed materials. Accordingly, the fibrous structure of the felt stock is of an extremely fragile and weak nature. Further, since the presence of fillers and binders would prevent or impede penetration of the asphalt into the felt stock and no such materials are provided, no reinforcing and binding effect which might be offered by such materials is provided. Still further, the felt stock must be as dry and free of moisture as is possible when it is submerged in the hot bath of asphalt, as the presence of water and moisture in the felt, under the temperatures encountered generates steam within the felt which urges the asphalt out and away from the felt as it escapes therefrom and which frequently causes the felt to expand, develop blisters and rupture, which renders it unsuitable for sale and use.

As a result of the above, the felt stock is extremely weak, brittle and fragile before it is impregnated or saturated with the asphalt. It is difficult to handle and the quantity which is damaged and lost in the course of producing roofing felt is substantial.

When the felt stock is saturated or impregnated with asphalt, the asphalt serves as a filler and binder to greatly increase the strength and stability of the fibrous structure. The asphalt itself must be of a nature and consistency so that it will not flow under maximum anticipated temperatures of the environment in which it is to be used and is such that it normally becomes hard and quite brittle when it is cooled to temperatures below the anticipated mean temperature of the environment in which it is to be used. When the roofing felt is cooled to or below the anticipated mean temperature in which it is to be used, at which temperature the asphalt becomes brittle, the noted advantageous effects afforded frequently asphalt are frequency lost and the felt becomes so brittle and fragile that it cannot be worked.

As a result of the above and as is commonly recognized, ordinary roofing felt can be worked when it is sufficiently warm to render it soft and pliable, as during warm summer days and cannot be worked at night and during the cold days, unless it is suitably warmed by some special source of heat.

Attempts have been made to make the felt stock more flexible and pliable so that it can be more conveniently and effectively handled prior to and during treating it with asphalt and so that the finished product or roofing felt remains flexible or less subject to becoming brittle when chilled, but such attempts have failed.

Such attempts to make roofing felt more pliable have, characteristically, involved the application of a light oil to the felt stock, at some stage of its manufacture prior to treating it with asphalt. Common or ordinary oils alone will not effectively and uniformly penetrate the felt when it is wet and tends to trap free water in the felt, both of which factors are undesirable. Applying oil alone to the felt when it is dry requires the use of excessive amounts of oil to effect desired and effective saturation of the felt. Further, if sufficient light oil, alone, is present in the felt to render it pliable, it acts as a solvent which thins and causes the asphalt to become excessively tacky and fluid, after the product is finished. If the last factor is compensated for by using a harder asphalt, the effect of the oil is counteracted and nothing is gained.

The ordinary roofing asphalt, being composed of combustible fibers and asphalt, is highly flammable and presents a definite fire hazard. To date, no economically feasible means of fire-proofing roofing felt has been found. One means employed in reducing the fire hazard associated with roofing felt has been to coat or dust the surfaces of the product with a dry chemical, such as sodium bicarbonate, which chemical readily sticks and adheres to the tacky asphalt. While such practices serve to retard ignition of the product, they are substantially ineffective when the product is once ignited and heated sufficiently to liquefy the asphalt to an extent that the fire retardant treated surfaces thereof become fluid and unstable. Further, fire retardant chemicals applied to the surfaces of roofing felt are subject to being blown and washed away by wind and rain at such a rapid rate that the effective use thereof is extremely questionable.

Attempts to impregnate the felt stock with a fire retardant chemical have failed to bring about satisfactory, uniform, results since the chemicals, which must be included in the felt before dipping and treating the felt with asphalt, act as a filler and/or coat the fibers of the felt in a manner that prohibits or unduly inhibits the desired, uniform, penetration of the asphalt into the felt.

An object and feature of my invention is to provide a novel process and means for establishing inexpensive, soft, porous, flexible felt stock, particularly suitable for saturation and/or impregnation with asphalt and the establishing of tar paper or roofing felt.

It is an object and feature of the instant invention to provide a novel means and process for establishing roofing felt wherein the felt stock remains sufficiently flexible and non-brittle that it will not fracture, break or readily tear when the asphalt is chilled to a brittle condition and is flexed to an extent that the asphalt is caused to craze.

Yet another object and feature of my invention is to provide a novel means and process for establishing a roofing felt which is effectively and substantially thoroughly impregnated with a fire retardant chemical and which sufficiently resists ignition and combustion to be classified as fire resistant.

Still another object and feature of my invention is to provide means and a process whereby the fibers of felt stock for the establishment of roofing felt are impregnated and rendered flexible and non-brittle by application and distribution of a treating fluid throughout the felt comprising a solution or emulsion of oil and water.

An object and feature of this invention is to provide felt stock of the character referred to above wherein the treating fluid is wholly or partially an inverted emulsion of oil and water wherein the fine droplets of water are surrounded by or within the oil whereby the apparent water content of the fluid is substantially undetectable under normal conditions and the stock is such that it is substantially and/or effectively anhydrous, containing no free water during the bathing and treating of the felt stock in hot molten asphalt in the course of establishing roofing felt therefrom.

Still further, it is an object of the present invention to provide means and a process for establishing felt stock and finished roofing felt of the character referred to above wherein the water of the treating fluid mixture is ladened with and carries with it, in solution, a suitable fire retardant chemical, such as sodium bicarbonate, whereby the felt stock and resulting roofing felt is thoroughly and uniformly impregnated with the fire retardant chemical and is rendered more fire resistant.

It is an object and feature of this invention to apply and treat the felt stock with the above referred to treating fluid of chemical ladened water and oil during the production of the felt stock after the free water employed to establish the stock has been extracted from the stock, before the stock is completely dried and at that time when the cells of the fibers are still sufficiently damp and moisture conditioned to freely admit the treating fluid.

The foregoing and other objects and features of my invention will be apparent and fully understood from the following detailed description of a typical and preferred carrying out of the invention throughout which description reference is made to the accompanying drawings, in which:

FIG. 1 is a diagrammatic view of a typical paper mill apparatus arranged and disposed for carrying out my new process; and FIG. 2 is a diagrammatic view of a typical apparatus employed to treat felt stock with asphalt in accordance with my new process.

The process provided by the present invention, in its broadest aspects, consists of saturating damp, moisture conditioned paper felt stock with a treating fluid comprising a solution and/or emulsion of oil and water, then drying the felt to drive off excess and free water, next submerging and dipping or bathing the treated felt in a hot molten bath of asphalt and permitting the asphalt to permeate and saturate the felt, then extracting the felt from the bath and permitting the excess asphalt to drain therefrom and finally cooling the fluid treated asphalt saturated felt stock.

In carrying out the above, it is important and desirable that the felt stock have no free water in it when the treating fluid is applied to it as such excess or free water will prevent or impede the free and uniform flow and penetration of the treating fluid into and throughout the felt stock. This fact can be readily understood when it is recognized that the treating fluid, due to the low specified gravity of the oil therein, is lighter than the water and will not readily displace any free water trapped and held within the fibrous structure of the felt.

While it is desirable that all free water be extracted from the felt, for the reasons set forth above, a small or limited amount of such water can remain dispersed throughout the felt, so long as it is not present in sufficient quantities and in sufficiently large masses as would prevent substantially complete and uniform saturation of the felt with the treating fluid.

It has been found that small, dispersed amounts of free water in the felt at the time the treating fluid is applied and about which the fluid can freely flow, is effectively combined with and becomes a part of the fluid or is effectively displaced and moved from the felt without adverse effects when the felt is subsequently dried.

It can be otherwise explained that the felt cannot be so wet and saturated with free water that the treating fluid might float thereon or the flow of fluid into and throughout the felt is blocked thereby and/or such that the fluid might be excessively diluted should it combine therewith.

While it is important that the felt not be ladened with excessive free water when the treating fluid is applied thereto, it is equally important that it not be excessively dry. When the felt is dried to an extent that it has too little a moisture content, the fibers shrink, warp and crack, creating small corners and interstices into which fluids such as the treating fluid cannot flow due to the surface tension of the fluids. Further, when the fibers of the stock are dried, the cells of the fibers contract or shrink, creating interstices or voids between adjacent cells into which fluids with any appreciable surface tension cannot readily flow. When the fibers are let to become so dry that the cells thereof shrink and part, they become extremely weak and brittle.

In accordance with the above, in carrying out my invention, the felt should be sufficiently wet or damp and have sufficient moisture content so that the fibers have not begun to shrink excessively and such that the treating fluid is not prevented from freely flowing about the fibers and into the interstices created by the fibers and by the cells thereof.

In practice, the necessary or desired moisture content of the felt stock can vary widely depending upon the nature of the waste material of which the stock is established. For example, if the stock is established wholly of rag, the fibers of which are quite firm, long and dense, the moisture content of the stock when moisture conditioned for saturation by the oil-water emulsion or solution, may be as little as 5%, whereas, if the stock is established wholly of newspaper waste, the fibers of which are shorter, less dense and firm, the moisture content may be 30% or greater to effect proper moisture conditioning of the fibers.

Most often, the stock is established of a combination of different available fibrous waste materials and those materials are substantially continuously fed into the production of the felt in different or varying amounts; as a result, it is necessary or required that the moisture condition of the felt, as it is being produced, be continuously monitored and adjusted or varied so that the desired moisture condition is imparted thereto. Such monitoring of the moisture condition of the stock is, in practice, best effected at that point or step in the production of my new product where the oil and water emulsion or solution is introduced or applied to the stock and where the manner in which the treating fluid is absorbed or repelled by the felt stock can be suitably visually observed.

As a result of the above, it will be apparent that the amount of moisture in felt stock is not and cannot be practically established at any fixed amount and is determined or controlled by the nature of the fibers going to make up the stock. Accordingly, the stock is and can be best and properly defined as being "moisture conditioned" to receive and/or accept the treating fluid.

In the following descriptive matter and in the claims, when describing and qualifying the moisture content of the felt stock prior to application of the emulsion or solution, I will refer to and describe it as being "moisture conditioned," it being understood that such language means that the stock is conditioned with that volume or percentage of moisture which renders the stock capable of allowing the treating fluid to substantially freely penetrate and saturate the stock.

In practice, the treating fluid which consists primarily of oil and water can be varied widely as regards the ratio of oil to water. As little oil as is practical should be used so as not to unduly increase the cost of the end product and so as not to deposit or present so much oil as would tend to unduly dissolve and soften the asphalt of the finished product.

The oil that I employ in establishing my treating fluid is not a pure or natural oil, but rather is a prepared or treated oil of that general type or class of oil commonly called "soluble oil" and which has long been produced and sold by substantially all major oil producing and refining companies throughout the United States. In their most basic or simple form, soluble oils are mineral oils treated with sulphuric acid so that they are partially soluble in water and are said to establish an emulsion when mixed with water.

In accordance with present day practices, "soluble oils" are water emulsifiable products usually containing mineral oil, primary and secondary emulsifiers, coupling agents and in some instances, other additives, such as bactericides. When well formulated they readily form a stable and permanent emulsion with water and are such that they leave an oily film on parts after the water (emulsion) evaporates.

One such oil, produced and sold by Atlantic Richfield Company under the name "Soluble Oil Z" comprises 87.55 percent 100 pale oil, 7.0 percent sodium sulfonate, 3.2 percent naphthenic acid, 1.0 percent glutaraldehyde, and smaller amounts of other additives such as isopropanolomine, hexylene glycol and an antifoaming agent. The same company produces and sells "soluble oil DO" which comprises 80.7 percent oil, 10.9 percent sodium sulfonate, 6.0 percent potassium salt of rosin, 1.0 percent cellosolve, 0.3 percent oleic acid, 0.8 percent water and 0.3 percent pentachlorophenol.

The above examples of "soluble oil" and a great number of others commercially available soluble oils involving different formulas and commonly called and sold as "soluble oil" are intended to be mixed with water to establish emulsions and are intended for use as coolants, cutting oils, rust inhibitors and the like.

To the best of my knowledge, substantially any one of those oils which are called and sold as soluble oil and which mix with water to establish an emulsion can be advantageously used in carrying out my invention.

In practice, the recommended proportioning of oil and water in the case of commercially available soluble oils is largely dependent upon the use to which the emulsion is to be put. Suggested ratios generally range from 20 to 100 parts water to each part oil in those cases where the oils or emulsions are to be used as "cutting oil" in machinery operations. In those instances where the emulsions are to be used as coolants and/or rust inhibitors in the cooling systems of internal combustion engines and the like, suggested ratios may be as great at two hundred parts water to each part of oil.

In carrying out the instant invention and since the treating fluid is not employed as a lubricant, coolant, rust inhibitor or the like, but rather, is employed as a fiber conditioning medium, it has been determined that the ratios of oil and water suggested by the producers of the various commonly available soluble oils is not applicable and that considerably more water and less oil will establish a suitable and effective emulsion or treating fluid.

In some instances, the ratio of water to oil can be approximately one thousand to one.

The ratio of oil to water in the treating fluid employed in carrying out this invention is extremely variable and is not subject to being specified with particularity due to several variables that are always present. The variables which determine the preferable ratio of oil and water in establishing the treating fluid are: (1) how soft and/or flexible does the producer of the end product wish the product to be; (2) the inherent strength, flexibility and absorbtion characteristics of the felt stock which is being treated (which is dependent upon the nature of the raw waste materials used); and (3) the nature and characteristics of the particular batch or supply of asphalt employed in carrying out the invention. In addition to the above, the special nature and characteristics of the particular oil which is available, selected and used can greatly effect the preferred ratio of oil and water.

As a result of the above, and in practicing the instant invention, it has been determined that the most effective and satisfactory procedure to effect the preferred ratio of oil and water is to start the process with a ratio which is extremely low in oil, for example, one part oil to one thousand parts of water and to observe the nature and characteristics of the end product. If the end product is too stiff and brittle, more oil is added until product with desired characteristics is attained. Conversely, if the product becomes too soft and the asphalt appears to be dissolved and excessively tacky, more water is added.

It is to be noted that the above is not a matter of experimentation, but rather, is a matter of adjustment which must be made in light of those variables which are encountered and which require the exercise of a minimum amount of skill on the part of the persons practicing the invention.

When the treating fluid is deposited on the moisture conditioned felt, it rapidly penetrates the felt to combine with certain of the moisture in, about and between the fibers of the felt to substantially uniformly permeate the felt structure.

After the treating fluid is applied to and throughout the felt, the felt is substantially dried by subjecting it to appropriate heat and preferably to some pressure.

In the preferred carrying out of the invention, sufficient pressure is applied to the felt to displace and squeeze out or expell all excess free fluids and to thereby reduce the heat energy that would otherwise be required to dry the felt to a desired extent by heat alone.

The drying heat to which the felt is subjected is preferably slightly in excess of 212° F. or the boiling temperature of water so that all excess and free water is vaporized and exhausted from the felt.

The drying heat must, however, not be so high or great as to scorch or burn the fibers of the felt or vaporize the oil. Those various oils which I have used with satisfactory results have latent temperatures of vaporization of from 300° F. to in excess of 600° F.

In the course of drying the felt, a substantial portion of the water going to make up the treating fluid is vaporized and expelled, but the amount so expelled cannot be readily determined by the inventor with or by those testing means at his disposal. In practice, if an excess of that water is expelled, such can be corrected by adjusting the heat and/or the time period the heat is applied to the felt stock.

When the felt is dried to a desired extent, as above set forth, the felt, in accordance with normal procedures employed to test the water content of paper, is, from a practical standpoint substantially dry or anhydrous since the water or moisture which remains is so commingled, entrained and/or combined with the oil that its presence is not readily detected.

The felt, thus treated and dried, and which is soft and pliable, is next advanced or transported to and is submerged or emersed in a bath of heated molten or fluid asphalt and is bathed for a sufficient period of time to permit the asphalt to completely permeate and saturate the felt.

The asphalt is normally such that it is hard and brittle at temperatures of about 40° F. and below, is soft and plastic in a temperature range between 40° F. and 150° F. and becomes increasingly fluid, or less viscous, up to its latent temperature of vaporization which, depending upon the nature and amount of its more volatile ingredients, is from 400° F. to 600° F. The asphalt is a byproduct of petroleum refining processes and is such that its contents, temperature characteristics and fluidity is subject to substantial variations, depending upon the nature of the crude oil from which it is extracted and the refining process to which the crude oil has been subjected. Accordingly, each batch or supply of asphalt procured for the manufacture of roofing felt should be checked or tested to determine the temperature which it must be brought to in order to assure the most effective and economical treatment of felt.

In practice, the asphalt is heated to a temperature just below its boiling point and/or to a temperature just below a point where an apparently excessive amount of volatiles can be detected leaving or escaping from the heated bath of the material.

In practicing the instant invention and with the asphalt at my disposal, the asphalt is heated to between 500° F. and 550° F. which is and can be said to be to a temperature at which the material has the least viscosity below its latent temperature of vaporization.

While a lesser temperature would suffice, the bathing period would have to be appropriately extended to assure effective penetration and saturation of the felt. Further, the hotter and less viscous the asphalt the more rapidly and readily it will drain from the felt as the felt is extracted from the bath, thereby conserving of time and conserving of the asphalt material by assuring that little or no excess asphalt will adhere to and set up on the felt.

When the treated and dried porous felt is bathed in the heated asphalt, the asphalt readily and rapidly saturates the felt and, due to the anhydrous or substantially dry nature or condition of the treated felt, little or no appreciable amount of steam and/or gases are generated within the felt, by fluids therein and which would impede the penetration of the asphalt as it vents therefrom or which would damage the felt as by causing it to blister and/or rupture.

Ordinarily, in accordance with the practices of the prior art, during the treating of felt with hot asphalt and where excess or free moisture is in the felt, that moisture is vaporized and vents therefrom to blow through the asphalt in a violent manner, creating what is commonly considered extra hazardous conditions. With the treated felt and in carrying out the instant invention, such conditions are substantially eliminated.

After the felt is saturated with asphalt, it is extracted from the bath and excess asphalt is permitted to drain therefrom, when the structure is still hot.

Finally, the felt structure is permitted to cool and to thereby provide the desired finished product.

The finished product distinguishes from previous or common roofing felt in that it is softer, more pliable and therefore stronger and more durable than ordinary roofing felt. Further, it is more uniform and near perfect than ordinary roofing felt.

In addition to the above, it has been determined that in practicing my invention, the treating fluid or emulsion treated felt materially reduces the time period which the felt must be bathed in the asphalt and reduces the volume of asphalt required to establish a desirable finished product and that such savings more than offset the costs of the oil used to establish the emulsion or solution and its application to the felt stock. Accordingly, the process here disclosed results in a superior product with no appreciable increase in cost.

In accordance with the above disclosed broader aspects of my invention, it will be apparent that the felt stock can, if desired, be pre-manufactured dry paper-felt stock. In such a case, an initial step of wetting the prepared stock, preparatory to applying emulsion is required. In such a case, it is desirable that the stock, which is normally provided in spools, be wetted a considerable and adequate period of time before application of the emulsion to assure that all the fibers of the stock are suitably moistened.

Carrying my invention further, to provide a fire retardant product, the water employed in establishing the treating fluid is ladened with sodium bicarbonate, in solution. In practice, the amount of sodium bicarbonate can be varied, as desired, or as circumstances require. By tests, I have determined that a solution of 1 part sodium bicarbonate per 100 parts water, by weight, is more than adequate in the establishing of roofing felt with noticeably improved, fire-resistant or fire-retardant characteristics.

It is extremely important and necessary that the sodium bicarbonate be added to and dissolved in the water before the water and oil are mixed to establish the treating fluid or emulsion since the sodium bicarbonate cannot be effectively dissolved in the oil or in the emulsion or solution of the oil and the water.

In accordance with the above, it will be apparent that the sodium bicarbonate, being in solution in the water, is intimately combined in and with the emulsion and is carried into and deposited throughout the entire structure or body of the felt.

In tests, when the finished product that I provide has been ignited or set on fire, or when it has been exposed to a direct flame, the sodium bicarbonate is broken down by the heat and decomposed into soda, which covers the combustible materials with an air-excluding crust and into carbon dioxide gas, which combines with the vapor of the water of the treating fluid to displace the oxygen and smothers the fire.

Accordingly, the roofing felt structure provided by my invention, composed primarily of highly combustible and flammable materials, will not readily sustain combustion under ordinary conditions and is fire-resistant.

Sodium bicarbonate is extremely inexpensive and in the volume or quantity here required represents a negligible increase in the cost of the finished product.

It has been determined that the most practical amount of sodium bicarbonate employed is determined by saturation of the water with the material, that is, by adding as much of the material to the water as can be freely dissolved therein and not so much as would result in the presence of excess material which would tend to precipitate and settle out of the water.

In carrying out my invention further, an advantage to be achieved is the maintenance of the felt stock in a soft and flexible state and to avoid establishing the felt in a dry, brittle condition where it is weak, fragile and difficult to work and handle without being damaged and rendered useless.

To the above end, it is desirable and most economical to apply and treat the felt stock with the treating fluid during the manufacture of the felt stock and at that time after excess and free water has been extracted from the felt and prior to its being dried.

In FIGS. 1 and 2 of the drawings, I have illustrated a typical apparatus for the effective carrying out of my invention.

Referring to FIG. 1 of the drawings, the raw materials for the felt stock is fed into a shreader 10 as at 11. The raw materials for roofing felt are usually the least costly materials available and commonly include reclaimed newspaper and a small amount of peat. From the shreader the material is ordinarily conducted to a boiler 12; from the boilder it is conducted through a beater 14 to a mixer 15. As the material is advanced and worked upon in or by the boiler, beater and mixer, suitable water is introduced and admixed with the material to provide a pulp slurry of appropriate consistency.

From the mixer, the slurry is advanced to and deposited on a felting screen 16 by means of a distributor 17. In most paper mills, the felting screen is an elongate, endless wire closs screen which serves to continuously receive and transport pulp deposited thereon longitudinally of the line of production. The screen is commonly provided with vacuum means to enhance the proper disposition of the pulp slurry on the screen and to extract water therefrom.

The felted pulp is advanced from the screen through water extracting means 18 to mechanically remove all free and excess water therefrom. The means 18 is commonly a roller means with associated vacuum means related thereto and leaves the felt in a moist, damp condition.

Next, the damp felt is advanced through pressure rolls to compact it into sheet form and which are commonly referred to as felt rolls.

The flat, damp, compacted felt sheet is next advanced through drying means 19 which serves to drive off remaining moisture in the sheet and leave it dry. The drying means 19 commonly includes a set of steam heated rollers about which the felt sheet is engaged and advanced.

From the drier 19, the sheet is advanced to spooling or reeling means 20 where it is wound about a suitable spool for storage and subsequent handling.

The apparatus and manufacture steps illustrated in FIG. 1 and briefly described above is typical of the apparatus and manufacturing steps or process commonly employed by the prior art in the manufacture of felt stock for the manufacture of roofing felt.

In addition to the above noted apparatus and process steps, the instant invention includes the following additional intermediate steps and apparatus for effecting the same.

Suitable volumes of water and sodium bicarbonate are mixed together to dissolve the sodium bicarbonate and place it in solution in or with the water. The apparatus for effecting the foregoing can include a mixing tank 21 receiving water from a suitable water supply 22, a hopper means 23 for introducing sodium bicarbonate into the water in the tank 21 and a motor driving mixing means 24 related to the tank 21.

Next, the soda-ladened water is mixed and blended with a suitable, desired, relative volume of soluble oil to establish the treating fluid, emulsion or solution.

The apparatus provided for effecting the above can include a supply (or tank) of oil 25, a blender tank 26, means 27 to conduct the oil into the tank 26, means 28 to conduct the soda ladened water from the tank 21 to the tank 26 and motor driving mixing means 27 related to the tank 26.

Next, the treating fluid established in the tank 26 is deposited on and into the felt stock when said stock is moisture conditioned, as described in the foregoing and prior to its being advanced into and through the drying means 19. The apparatus provided for depositing the treating fluid onto the moisture conditioned stock preferably includes a spray nozzle 30 spaced from and opposing one flat surface of the felt stock and means for delivering the treating fluid from the tank 26 to the nozzle at an appropriate pressure to effect substantially uniform depositing of the treating fluid onto and throughout said surface of the felt stock. The nozzle 30 is shown located above the felt stock S between the means 18 and 19 and the means provided to deliver the treating fluid from the tank 26 to the nozzle 30 is shown as including a pump 31 and appropriate piping between the tank 26, pump 31 and nozzle 30.

If desired, and as illustrated, a second nozzle 30' can be provided to deposit the fluid onto the other or bottom surface of the felt.

With the apparatus thus far described, it will be apparent that a suitable treating fluid in the form of an emulsion or solution of water and oil is established and is appropriately deposited on the moisture conditioned felt stock and that the finished felt stock, at the reeling means 20, is the soft, flexible, dry, treated felt stock provided in accordance with the present invention.

The invention here provided next includes the step of bathing the treated felt stock in a hot molten bath of asphalt. This can be effected by bypassing the reeling means 20 and advancing the treated felt stock directly from the drier means to an asphalt bath 35 or can, as shown in FIG. 2, include and/or involve arranging a reeled supply 36 of treated felt stock at an inlet end of the bath 35.

The bath 35 can, as shown, include a simple elongate, upwardly opening tank with inlet and outlet ends and in which a supply of asphalt is deposited. A suitable heater means 37, such as a gas burner means, is related to the tank to heat the asphalt. The tank is preferably provided with rollers or guide means at its inlet end to guide the felt stock down and into submerged arrangement in the asphalt and similar means at the outlet end to guide the felt up and out of the asphalt in a manner so that excess asphalt can effectively drain therefrom and to direct it away from the bath for cooling. Additional means are provided for subsequent handling and/or use of the finished product. For example, and as shown at 38, the finished roofing felt can be respooled.

Considering this invention in another light or from another point of view, it might be said that the water of the treating fluid is utilized as a carrier for the purpose of transporting, distributing and depositing small, limited and/or controlled amounts of oil and/or sodium bicarbonate into and throughout the felt structure to render that structure flexible and/or impregnated with the fire retardant and that the water of the treating fluid is, from a practical standpoint, removed during the noted drying operation. In such a case, it could be said that the invention merely provides for coating the felt fibers with a thin coating of oil. Such a simplified view or interpretation of the invention, while possibly true in part, is not wholly correct and is apt to be misleading, since it has been determined that all water and moisture is not removed from the felt during the drying operation. The fact that substantial water is retained in the treated felt, though it takes on characteristics of being anhydrous, is evidenced by the weight of the finished product and further, by the fact that when it is subjected to flame substantial volumes of steam or water vapor is generated and escapes from the product to retard ignition or combustion thereof.

In light of the above, it is apparent that a substantial amount of water is so entrained and combined with the oil in the treating fluid that all of the water is not readily separated therefrom and/or that when the water of the fluid between fibers of the felt is vaporized and exhausted to leave an oil film on the exterior of the fibers, that film serves to seal the fibers whereby the water or moisture within said fibers is effectively retained therein, to render them soft and flexible and ready to be vaporized and to generate steam for the purpose of retarding ignition and/or sustain combustion of the product.

Having described my invention, I do not wish to be limited to the specific details set forth in the preceding but wish to reserve to myself any modifications and variations which may appear to those skilled in the art to which this invention pertains and which fall within the scope of the following claims:

Having described my invention, I claim:

1. The process for producing flexible non-brittle roofing felt comprising:

first, moisture conditioning a sheet of felted vegetable fiber to render the fibers soft, flexible, non-brittle and substantially free of free water and excess moisture;

second, depositing an emulsion comprising from 10 to 100 parts water to each part of an oil with emulsifier and coupling agents added, onto said sheet and permitting the emulsion to penetrate and saturate the fibers of the sheet, said oil having a higher temperature of evaporization than water;

third, extracting free emulsion from the sheet;

fourth, subjecting the sheet to a temperature between the temperatures of vaporization of the oil and water and evaporatively removing a sufficient portion of the moisture therefrom to render fiber surfaces of the sheet structure substantially anhydrous in nature and having sufficient oil and water within the fibers of the sheet structure to render the felt structure soft and flexible;

fifth, bathing the emulsion treated sheet in hot molten bath of asphalt and permitting the asphalt to penetrate the sheet structure;

sixth, extracting the sheet from the bath and permitting excess hot molten asphalt to drain therefrom;

finally, permitting the sheet to cool and the asphalt to solidify.

2. The process as set forth in claim 1 wherein the emulsion contains sufficient oil to surround the exteriors of the fibers of the felt structure with oil films subsequent to the fourth step of the process whereby emulsion within the fibers and at the surfaces thereof is sealed and contained within said films.

3. The process as set forth in claim 2 wherein the water going to make up the emulsion is substantially saturated with dissolved sodium bicarbonate before said water and oil are combined to establish said emulsion whereby sodium bicarbonate is carried by the emulsion and the end product has sodium bicarbonate distributed in and throughout the felt structure thereof.

4. The process as set forth in claim 1 wherein the water going to make up the emulsion is substantially saturated with dissolved sodium bicarbonate before said water and oil are combined to establish said emulsion wherein sodium bicarbonate is carried by the emulsion and the end product has sodium bicarbonate distributed in and throughout the felt structure thereof.

5. The process as set forth in claim 4 wherein the fibers and interstices between and about adjacent fibers of the moisture conditioned sheet contain sufficient moisture to reduce surface tension between the fibers and the emulsion whereby the emulsion flows freely throughout the felt structure.

6. The process as set forth in claim 1 wherein the fibers and interstices between and about adjacent fibers of the moisture conditioned sheet contain sufficient moisture to reduce surface tension between the fibers and the emulsion whereby the emulsion flows freely throughout the felt structure.

7. The process as set forth in claim 6 wherein the emulsion contains sufficient oil to surround the exteriors of the fibers of the felt structure with the oil films subsequent to the fourth step of the process whereby emulsion within the fibers and at the surfaces thereof is sealed and contained within said films.

8. The process as set forth in claim 7 wherein the water going to make up the emulsion is substantially saturated with dissolved sodium bicarbonate before said water and oil are combined to establish said emulsion whereby sodium bicarbonate is carried by the emulsion and the end product has sodium bicarbonate distributed in and throughout the felt structure thereof.

* * * * *